US005983969A

United States Patent [19]

Morgan

[11] Patent Number: 5,983,969

[45] Date of Patent: Nov. 16, 1999

[54] PURSE SPLIT INSERT

[76] Inventor: Hazel T. Morgan, P.O. Box 1629, Monterey, Calif. 93942

[21] Appl. No.: 09/096,805

[22] Filed: Jun. 12, 1998

[51] Int. Cl.[6] ..... A45C 1/02; A45C 13/02

[52] U.S. Cl. ..... 150/104; 150/113; 190/110

[58] Field of Search ..... 150/103–105, 150/111, 113; 190/110

[56] References Cited

U.S. PATENT DOCUMENTS

| | | | |
|---|---|---|---|
| 2,464,312 | 3/1949 | Holden | 150/113 |
| 2,624,385 | 1/1953 | Hogan | 150/113 |
| 2,844,179 | 7/1958 | Koret | 150/111 |
| 2,893,457 | 7/1959 | Wilson | 150/113 X |
| 3,414,033 | 12/1968 | Tucker | 150/113 X |
| 3,533,459 | 10/1970 | Ody | 150/113 |
| 3,963,102 | 6/1976 | Carp | 150/113 X |
| 4,161,201 | 7/1979 | Carp | 150/113 X |
| 4,263,951 | 4/1981 | Siegel | 150/100 |
| 5,207,254 | 5/1993 | Fromm | 150/104 |

*Primary Examiner*—Sue A. Weaver
*Attorney, Agent, or Firm*—Henry M. Stanley

[57] ABSTRACT

A split insert pair for a purse is made of fabric which is stiffer at the outside walls and less stiff at the end walls and which has an upper opening which is capable of either being opened wide or held in closed position by fasteners located on opposite sides of the upper opening. Various upwardly opening pockets are situated on the inside and outside surfaces of the insert walls to receive the usual articles carried in a purse. An outside wall on each of the inserts of the pair is provided with matching patterns of releasable fasteners, so the pair of inserts is useable as a unitary joined pair or as separate inserts which may be placed in separate purse compartments.

16 Claims, 2 Drawing Sheets fig_1
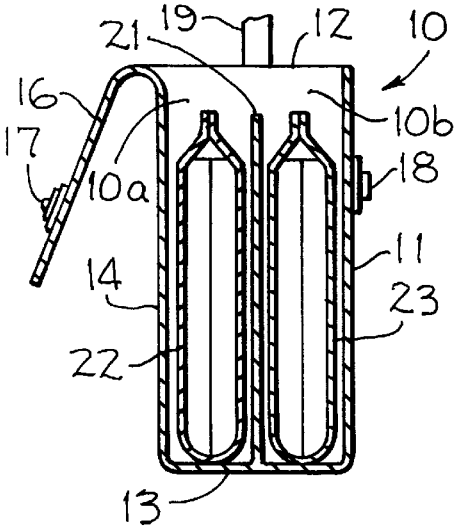
fig_2
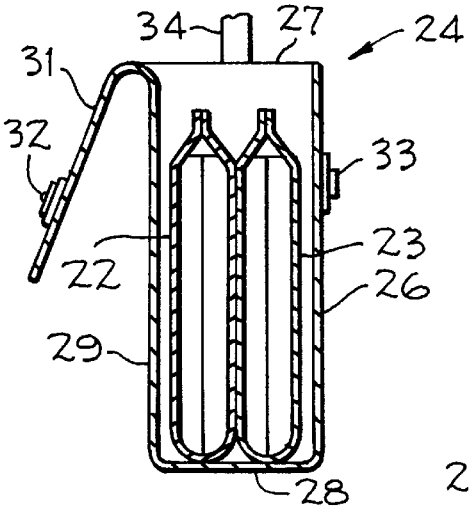
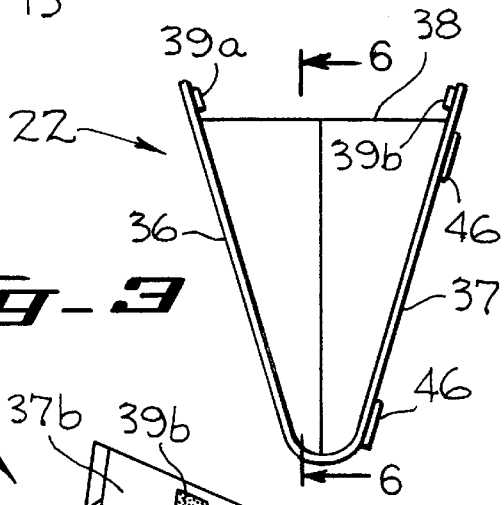
fig_3
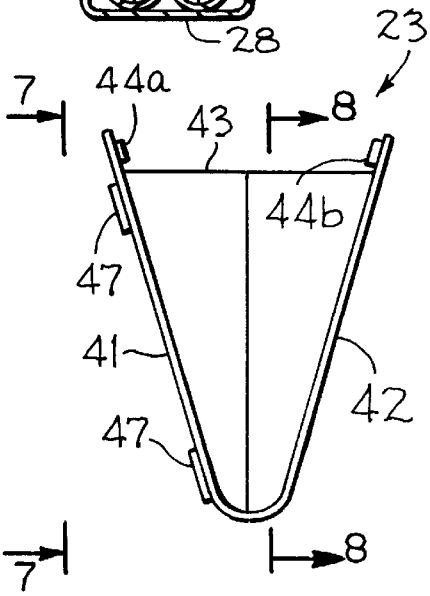
fig_4
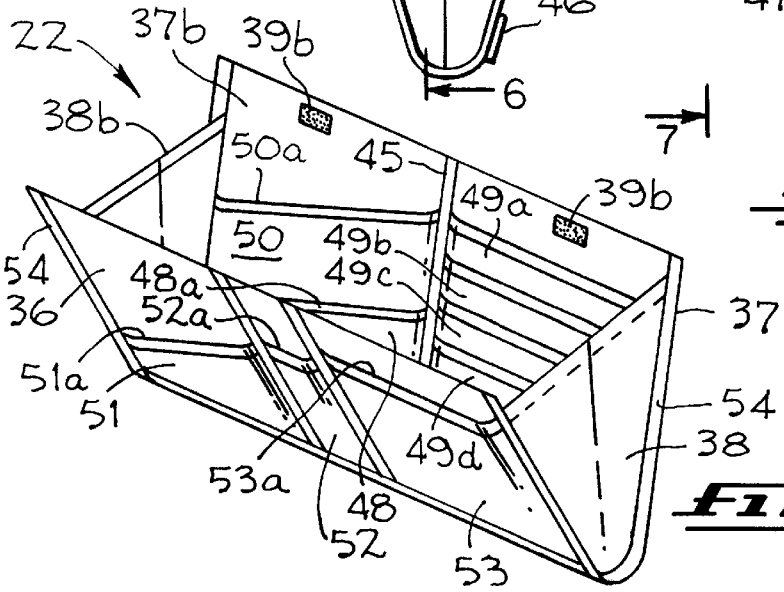
fig_5

PURSE SPLIT INSERT

SUMMARY OF THE INVENTION

The invention herein relates to a purse split insert for insertion in a purse having two separated compartments as well as in a purse having a single compartment. First insert means is provided having an exterior wall, an interior wall and opposing collapsible end walls. The exterior and interior walls have lower edges thereon and are joined together at the lower edges. Further, the first insert means has opposing sides which are connected by the opposing collapsible end walls which extend therebetween and thereby form an upper opening in the first insert means. Inside and outside surfaces are present on the first insert means exterior and interior walls. A plurality of flexible sheet-like members have lateral and lower peripheral edges and lie alongside and adjacent to portions of the exterior wall inside and outside and the interior wall inside surfaces. Means is provided for attaching the flexible sheet-like members at the lateral and lower peripheral edges to the adjacent portions of the exterior wall inside and outside and the interior wall inside surfaces to form a first plurality of upwardly opening article receiving pockets which are accessible at the first insert means exterior wall outside surface as well as through the first insert means upper opening. Second insert means has an exterior wall, an interior wall and opposing collapsible end walls. The latter exterior and interior wall have lower edges thereon and they are joined therealong. Further, the exterior and interior walls have opposing sides which are connected by the last mentioned opposing collapsible end walls to thereby form an upper opening in the second insert means. Inside and outside surfaces are present on the second insert means exterior and interior walls. A plurality of flexible sheet-like members having lateral and lower peripheral edges lie alongside and adjacent to portions of the exterior wall inside and outside and the interior wall inside surfaces. Means is provided for attaching the lateral and lower peripheral edges to the adjacent portions of the exterior wall inside and outside and the interior wall inside surfaces to thereby form a second plurality of upwardly opening article receiving pockets which are accessible at the second insert means exterior wall outside surface as well as through the second insert means upper opening. Releasable means is provided for attaching the first insert means interior wall outside surface to the second insert means interior wall outside surface. As a result, engagement of the releasable means facilitates insertion of the purse split insert in the purse having a single compartment and release thereof facilitates insertion in the purse having two separated compartments.

A purse split insert is disclosed which is insertable into first and second purse compartments within a split compartment purse and into a sole compartment within a single compartment purse. A first purse insert has a first exterior wall which has a lower edge and opposing lateral edges. A first interior wall is present on the first purse insert wherein the first interior wall has a lower edge and opposing lateral edges. A first pair of expandable opposing end walls is also present in the first purse insert. The first exterior and interior walls are joined at the lower edge and the first pair of expandable opposing end walls are attached to and extend between the first exterior and interior walls at the opposing lateral edges so that an upper opening is formed in the first purse insert. A second purse insert has a second exterior wall which also has a lower edge and opposing lateral edges. A second interior wall is present on the second purse insert wherein the second interior wall also has a lower edge and opposing lateral edges. A second pair of expandable opposing end walls is also present on the second purse insert. The second exterior and interior walls are joined at the lower edges and the second pair of expandable opposing end walls are attached to and extend between the second exterior and interior walls at the opposing lateral edges. In this fashion an upper opening is formed as well in the second purse insert. Releasable means are provided for attaching the first interior wall to the second interior wall so that the first and second purse inserts are selectably joined together and separated for insertion within a single compartment purse and within a split compartment purse, respectively.

A purse split insert is provided for placement as separate inserts within separate purse compartments in a split compartment purse and as a unitary insert within a single compartment in a single compartment purse. A first folded continuous member has opposing lateral sides and ends positioned in spaced side by side relationship. First means is provided for joining the opposing lateral edges whereby a first upper opening is formed between the first folded continuous member spaced ends. A second folded continuous member is provided having opposing lateral edges and ends positioned in spaced side by side relationship. Further, second means is provided for joining the opposing lateral edges, whereby a second upper opening is formed between the second folded continuous member spaced ends. Releasable means is provided for attaching the first and second folded continuous members together so that the first and second upper openings are in adjacent side by side relationship.

BRIEF DESCRIPTION OF THE DRAWINGS

FIG. 1 is a section through a split compartment purse showing the purse split inserts of the present invention in place.

FIG. 2 is a section through a single compartment purse showing the purse split insert of the present invention in place.

FIG. 3 is an end view of one insert in the purse split insert.

FIG. 4 is an end view of another insert in the purse split insert.

FIG. 5 is an isometric of the purse split insert of FIG. 3.

DESCRIPTION OF THE PREFERRED EMBODIMENTS

Figure 6:
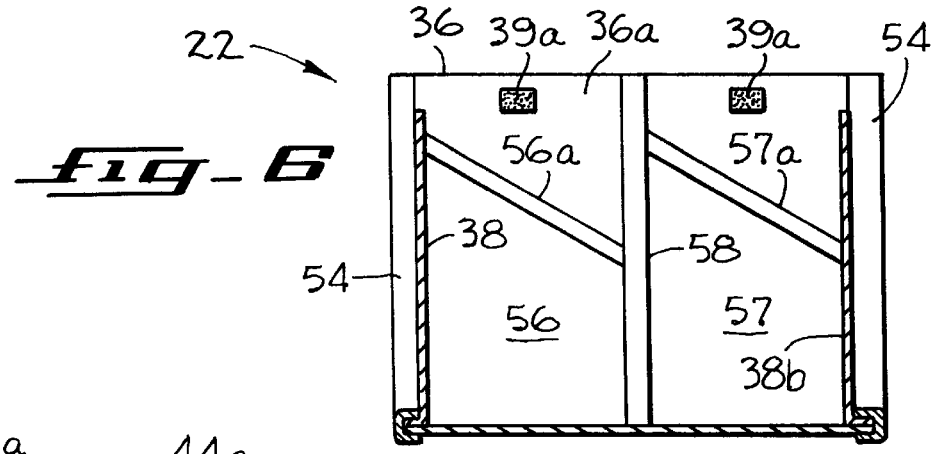
FIG. 6 is a section along the line 6—6 of FIG. 3.

Ladies' purses are generally coordinated with other articles of ladies' dress, whereby it is not uncommon for several purses to be included in a lady's wardrobe. It therefore becomes necessary to shift articles commonly carried in a purse to a different purse when a change in attire requires it. The invention to be described herein is intended to facilitate the shifting of commonly carried articles from one purse to another purse.

With reference to FIG. 1, a split compartment purse 10 is shown in section wherein the purse has an outer wall 11, a pair of end walls (one of which is shown as item 12 in the section of FIG. 1), a bottom wall 13 and an opposing wall 14, thereby creating an upper opening in the purse 10. A closure flap 16 extends from the upper portion of the opposing wall 14 having one portion of a snap fastener 17 mounted on the inside surface thereof. The closure flap 16, when placed over the upper opening shown in the purse 10, brings the portion 17 of the snap fastener into contact with a mating portion 18 of the fastener for securing the closure flap in place over the upper opening. A carrying strap 19 for the hand, arm or shoulder is shown extending from the end wall 12 in FIG. 1. A separator wall 21 is shown inside the purse 10 which separates the interior of the purse into two compartments shown as 10*a* and 10*b* in FIG. 1. A left purse split insert 22 is seen within the compartment 10*a* and a right purse split insert 23 is shown within the compartment 10*b* of split purse 10. It may be seen in FIG. 1 that the split inserts 22 and 23 are separated from one another by the separator wall 21.

Turning to FIG. 2, a purse 24 is shown having a wall 26, a pair of end walls (one of which is shown in the section of FIG. 2 as item 27), and a bottom wall 28. An opposing wall 29 is shown, from the upper portion of which extends a closure flap 31. One portion of a snap 32 (or other fastening means) is shown on the inner surface of the closure flap 31 so that the closure flap may be positioned over the upper opening shown in the purse 24 and come into engagement with a mating part 33 of the snap mounted on the wall 26 of the purse 24. Again, a strap 34 is shown for carrying the purse 24 by hand, over the arm or over the shoulder. The purse split inserts 22 and 23 are seen within the single compartment in the purse 24 in contact with one another along one wall thereof and fastened together in a fashion and by means which will be hereinafter described .

One portion of the purse split insert described herein is seen in FIG. 3 as the insert 22. Insert 22 has an exterior wall 36 and an interior wall 37. The exterior and internal walls 36 and 37 run into and out of the paper as seen in FIG. 3, having lateral edges, one of which is visible in FIG. 3. Expandable/collapsible end walls, one of which is shown at 38 in FIG. 3, extend between the opposing lateral edges of exterior and interior walls 36 and 37 of insert 22. Consequently, an upper opening is formed in insert 22 which is selectively opened and closed by moving the upper reaches of walls 36 and 37 toward and away from each other. The end walls, represented by item 38, are made of a relatively flexible fabric, while the exterior and interior walls 36 and 37, respectively, are fabricated from a stiffer fabric. Mating fastener pairs 39*a* and 39*b* are positioned on the inside surfaces of the upper reaches of walls 36 and 37 so that the upper opening in the insert 22 is held in a closed position by the mating fastener pairs when the upper ends of the walls 36 and 37 are moved together.

Turning now to FIG. 4 of the drawings, the purse split insert 24 is seen having an interior wall 41, an exterior wall 42, and expandable/collapsible end walls, one of which is shown at 43 in FIG. 4. As described in connection with insert 22, the walls 41 and 42 of insert 23 are fabricated from a relatively stiff material, while the end walls represented by item 43 are made from a thinner material with less stiffness. As a result, the interior and exterior walls 41 and 42, respectively, of insert 23 may be moved together or spread apart to vary the size of an upper opening therein. Once again, when the upper portion of the internal and external walls of the insert 23 are moved together until they are in contact, pairs of mating fasteners shown as items 44*a* and 44*b* are engaged to maintain closure of the upper opening.

Both of the inserts 22 and 23, as shown in FIGS. 3 and 4, display joinder of the external and internal walls 36 and 37 of insert 22 and the external and internal walls 42 and 41 of the insert 23 at the lower portions thereof. The exterior and interior walls of the inserts 22 and 23 are perceived in one form to be fabricated of a continuous wall member which extends from the upper portion of the interior wall past the lower portions of the walls to the upper portion of the exterior wall. In this fashion, the exterior and interior walls of each of the inserts are formed by a folded continuous member, with the ends of the member in spaced apart relation when the insert upper opening is opened. Alternatively, each of the interior and exterior walls of each insert may be fabricated from separate wall members having lower edges which are joined together, as by sewing, to form interior and exterior wall combinations as shown in FIGS. 3 and 4.

In FIG. 3, at an upper position and at a lower position on the interior wall 37 a portion of a fastener 46 such as a strip of Velcro™ is seen affixed to the internal wall. As seen in FIG. 4, in corresponding upper and lower positions on the interior wall 41, mating portions 47 for the fastener portion 46 are seen affixed to the interior wall. The fastener portions 46 and 47 could as well be snaps or any other suitable releasable fastening means. In this fashion, the interior walls 37 and 41 of inserts 22 and 23, respectively, when placed in contact are held in side by side position by the mating features of the fastener portions 46 and 47.

It may be seen that when the mating portions of the fasteners 46 and 47 are engaged, the purse split insert portions 22 and 23 are held together by the fasteners and the unitary combination of the purse split insert is insertable within the single compartment of purse 24 as seen in FIG. 2. When the purse split insert of the present invention is to be used in a split compartment purse such as purse 10 in FIG. 1, the fastener portions 46 and 47 seen in FIGS. 3 and 4 are released and the inserts 22 and 23 are individually placed within the separated compartments 10*a* and 10*b*, respectively, as shown in FIG. 1. It should be noted that in FIGS. 1 and 2 the inserts are shown with the upper opening fasteners 39*a*/39*b* and 44*a*/44*b* engaged so that the upper openings in each of the inserts 22 and 23 are closed.

Turning now to FIG. 5 in the drawings, an isometric of the insert 22 is shown. The inside surface of interior wall 37 is designated 37*b* in FIG. 5. The inside surface 37*b* is divided into two halves by a sewn member 45 attached to the inside surface. A pair of slant top pockets 50 and 48 are formed between the sewn member 45 and the collapsible/expandable end wall designated 38*b* in FIG. 5. The pockets 50 and 48 occupy the left side of the inside surface 37*b*in FIG. 5 and are formed by sewing the lateral and lower peripheral edges of a piece of sheet-like fabric in place leaving the upper peripheral edge open. In this fashion upper openings 50*a* and 48*a* are provided in the pockets 50 and 48.

On the right side of the inside surface 37*b* of interior wall 37 as seen in FIG. 5, a plurality of sheet-like pieces of fabric are sewn between the sewn member 45 and the expandable/collapsible end wall 38 at stepped heights on the inside surface. The number of sheet-like members 49*a*, 49*b*, 49*c* and 49*d* are also sewn at the lower peripheral edges to the inside surface 37*b* to form upwardly opening pockets for receiving items such as credit cards, etc.

The outside surface of exterior wall 36 as seen in FIG. 5 has sheet-like members 51, 52 and 53 sewn thereto at the lateral and lower peripheral edges thereof to form respectively a slant top pocket having an opening 51*a*, a pen or other tubular article receiving pocket having an upper opening 52*a*, and an additional pocket having an upper opening 53*a*.

FIG. 6 shows the inside surface 36*a* of exterior wall 36. The portions of the upper opening closure fasteners 39*a* are shown near the upper edge of the inner surface 36*a*. A strip of bias tape 54 is seen running down the lateral edges of the exterior wall 36 in FIG. 6 which when sewn in place along the lateral edges fixes the edges of the collapsible/expandable end walls 38 and 38*b* to the inside surface 36*a* of the exterior wall 36 at either lateral edge thereof. Further, a sewing operation at the lateral edges of exterior wall 36 secures one edge of slant top pockets 56 and 57 to the inside surface 36*a* of exterior wall 36. The opposing edges of the slant top pockets are secured to the inside surface 36*a* by a sewn member 58 running from the upper to the lower portion of the inside surface 36*a*. The slant top pockets 56 and 57 have upper openings as shown at 56*a* and 57*a*.

Figure 7:
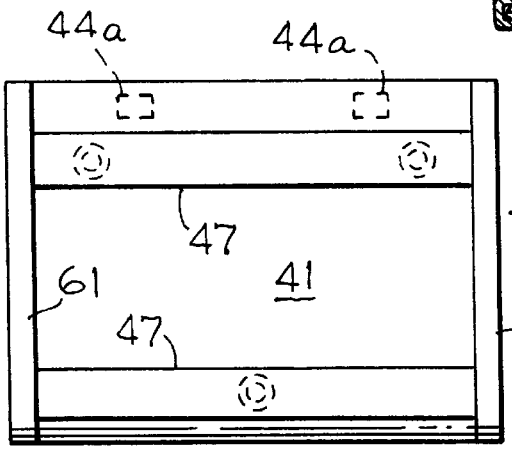
FIG. 7 is a section along the line 7—7 of FIG. 4.

FIG. 7 shows the outside surface of interior wall 41 and the mating portions 47 of the fastening combination 46/47 which affixes inserts 22 and 23 together in releasable fashion. It should be noted in FIG. 7 that the fastener portions 47 are depicted as Velcro™ strips. Velcro™ is a known "loop and hook" type fastener. The fastener portions could as readily be portions of snap type fasteners. In such a case a corresponding pattern of matching portions of snap type fasteners would be affixed to the outside surface of interior wall 37 in insert 22. FIG. 7 further shows a bias tape 61, similar to bias tape 54 in FIG. 6, which is sewn along the lateral edges of interior wall 41.

Figure 8:
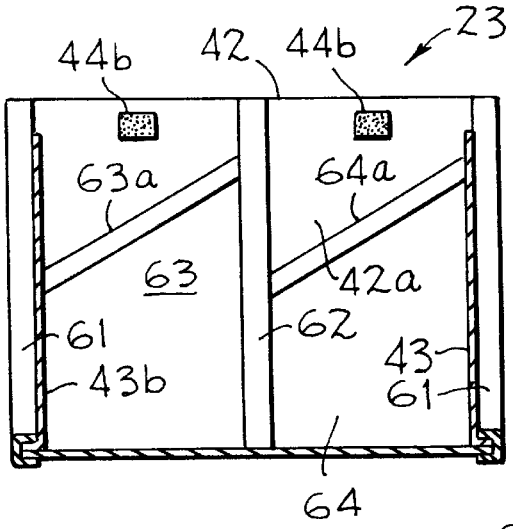
FIG. 8 is a section along the line 8—8 of FIG. 4.

FIG. 8 shows an inside surface 42*a* of the exterior wall 42 in purse split insert portion 23. The bias tape 61 strip is shown attached to the lateral edges of the exterior wall 42 serving to hold the expandable/collapsible wall 43 in place at one side of the insert and an opposing expandable/collapsible end wall 43*b* in place at the opposing side of the exterior wall 42. A sewn member 62 is shown extending from the upper edge of exterior wall inside surface 42*a* toward the lower edge thereof. Sheet-like members 63 and 64 have lateral and lower peripheral edges which are sewn, and therefore fixed to the inside surface 42*a* in conjunction with affixing the bias strips 61 in place and the affixing of the sewn member 62 in place. An upper slant top opening 63*a* provides access to an upwardly opening pocket thus formed by sheet-like member 63. In like fashion, an opening 64*a* provides access to a pocket thus formed by the sheet-like member 64.

Figure 9:
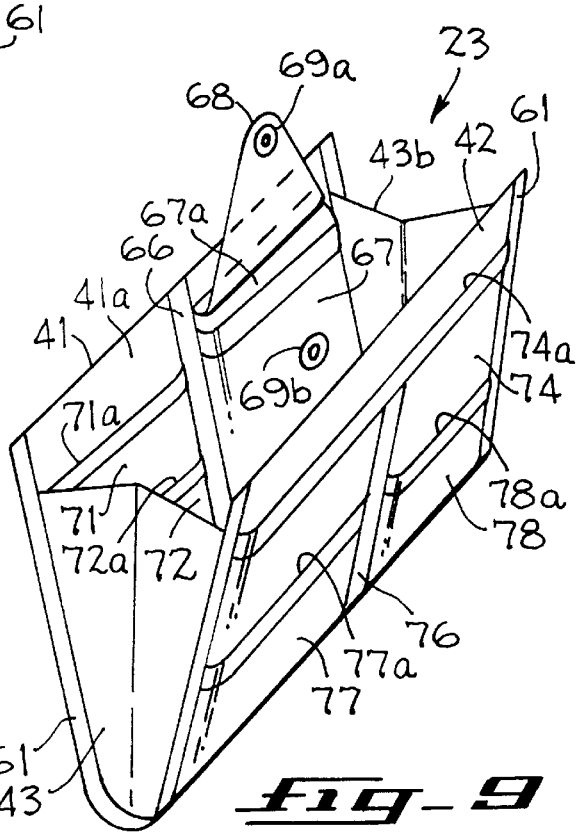
FIG. 9 is an isometric of the purse split insert of FIG. 4.

FIG. 9 is a perspective of the purse split insert portion 23 wherein the outside surface of exterior wall 42 and the inside surface 41*a* of interior wall 41 are visible. Expandable/collapsible end walls 43 and 43*b* are shown in partially closed or collapsed condition. Inside surface 41*a* has a sewn member 66 extending from the upper to the lower portions of the inside wall which serves to fix one edge of a sheet-like member 67 to the inside surface. The opposing side of the sheet-like member 67 is affixed to the inside surface 41*a* at the same time and by the same means for affixing the bias tape 61 and one edge of the expandable/collapsible wall 43*b* to the inside surface. The lower peripheral edge of the sheet-like member 67 is also fixed to the inside surface 41*a* as by sewing or through the use of an adhesive or the like. As a result, the sheet-like member 67 forms a pocket with an upper opening 67*a* therein. The opening 67*a* has a cover flap 68 attached to the inside surface 41*a* immediately thereabove. A fastener portion 69*a* is attached to the inside surface of the cover flap 68 which, when the flap 68 is lowered, is brought into contact with a mating fastener portion 69*b* attached to the outer surface of the sheet-like member 67. In this fashion a closure cover is provided for the opening 67*a* to allow articles to be deposited through the opening 67*a* into the pocket when the flap 68 is raised and to secure the articles within the pocket when the fastener portions 69*a* and 69*b* are brought into engagement. The fastener portions 69*a* and 69*b* may be closure devices such as snap fasteners as shown in FIG. 9. Further sheet-like members 71 and 72 are secured at the lateral edges thereof by the sewn member 66 and the bias tape 61 adjacent the expandable/collapsible end wall 43 on insert 23. The sheet-like members 71 and 72 have their lower peripheral edges fixed to the inside surface 41*a* in FIG. 9. As a consequence, openings 71*a* and 72*a* are provided which allow articles to be inserted therethrough and retained within pockets formed by the inside surface 41*a* and the sheet-like members 71 and 72.

With further reference to FIG. 9, a fabric sheet 74 is depicted having its lateral edges secured to the outside surface of exterior wall 42 by the bias tape 61 at opposing lateral edges of the exterior wall. An upwardly-oriented opening 74*a* which extends across the width of the exterior wall 42 is thereby formed for receiving and storing larger flat articles therein. Another sewn member 76 extends from the opening 74*a* to the lower portion of the exterior wall 42. Sheet-like members 77 and 78 are fixed at their adjacent lateral peripheral edges by the sewn member 76 and at their opposing lateral edges by the bias tape 61 fixed to the opposing lateral edges of the insert 23. Sheet-like members 77 and 78 are secured across their lower peripheral edges to the outside surface of the exterior wall 42. A pair of pockets are thereby formed on the outer surface of the sheet-like member 74 having upwardly extending openings 77*a* and 78*a* therein.

It may be seen from the foregoing that a purse split insert has been disclosed which is useful in split compartment or single compartment purses and which readily conveys articles generally contained within a purse from one purse to another regardless of purse type.

Although the best mode contemplated for carrying out the present invention has been shown and described herein, it will be understood that modification and variation may be made without departing from what is regarded to be the subject matter of the invention.

What is claimed:

1. A purse split insert for insertion in a purse having two separated compartments and in a purse having a single compartment, comprising first insert means having an exterior wall, an interior wall and opposing collapsible end walls, said exterior and interior walls having first lower edges thereon and being joined therealong, and further having opposing sides with said opposing collapsible end walls extending therebetween to thereby form a first upper opening in said first insert means, inside and outside surfaces on said first insert means exterior and interior walls, said first insert means exterior and interior walls having first upper edges thereon, means positioned in registered opposing relationship on said inside surfaces adjacent said first upper edges for releasably fastening said first upper edges together, whereby said first upper opening is adaptable to assume open and closed modes, means for attaching said opposing collapsible end walls to said inside surfaces on said first insert means exterior and interior walls, a first plurality of flexible sheet-like members having lateral and lower peripheral edges, lying alongside and adjacent to portions of said first insert means exterior wall inside and outside surfaces and said interior wall inside surface, means for attaching said first plurality of flexible sheet-like members at said lateral and lower peripheral edges to said adjacent portions of said first insert means exterior wall inside and outside surfaces and said interior wall inside surface to form a first plurality of upwardly opening article receiving pockets accessible at said first insert means exterior wall outside surface and through said first insert means upper opening, second insert means having an exterior wall, an interior wall and opposing collapsible end walls, said latter exterior and interior walls having second lower edges thereon and being joined therealong, and further having opposing sides with said opposing collapsible end walls extending therebetween to thereby form a second upper opening in said second insert means, inside and outside surfaces on said second insert means exterior and interior walls, said second insert means exterior and interior walls having second upper edges thereon, means positioned in opposing relationship on said inside surfaces adjacent said second upper edges for releasably fastening said second upper edges together, whereby said second upper opening is adaptable to assume open and closed modes, said opposing collapsible end walls on said second insert means extending to a height below said second upper edges on said exterior and interior walls, means for attaching said opposing collapsible end walls to said inside surfaces on said second insert means exterior and interior walls, a second plurality of flexible sheet-like members having lateral and lower peripheral edges lying alongside and adjacent to portions of said second insert means exterior wall inside and outside surfaces and said interior wall inside surface, means for attaching said second plurality of flexible sheet-like members at said lateral and lower peripheral edges to said adjacent portions of said second insert means exterior wall inside and outside surfaces and said interior wall inside surface to form a second plurality of upwardly opening article receiving pockets accessible at said second insert means exterior wall outside surface and through said second insert means upper opening, and releasable means for attaching said first insert means interior wall outside surface to said second insert means interior wall outside surface, whereby engagement of said releasable means facilitates insertion of the purse split insert in the purse having a single compartment and release thereof facilitates insertion in the purse having two separated compartments.

2. The purse split insert of claim 1 wherein said first plurality of upwardly opening article receiving pockets comprises an opening cover flap, and releasable closure means disposed between said cover flap and at least one of said plurality of flexible sheet-like members, whereby articles such as coins are held securely within.

3. The purse split insert of claim 1 wherein said first plurality of upwardly opening article receiving pockets comprises closure means attached across at least one of said first plurality of upwardly opening article receiving pockets.

4. The purse split insert of claim 3 wherein said first plurality of upwardly opening article receiving pockets have upper pocket openings therein, said closure means comprising cooperating snaps located at one of said upper pocket openings between at least one of said wall inside and outside surfaces and at least one of said flexible sheet-like members.

5. The purse split insert of claim 1 wherein said releasable means comprises first attachment means fixed to said first insert means inside wall exterior surface in a predetermined pattern, and second attachment means fixed to said second insert means inside wall exterior surface in a pattern which is in registration with said predetermined pattern.

6. The purse split insert of claim 5 wherein said first and second attachment means comprises cooperating snaps.

7. The purse split insert of claim 5 wherein said first and second attachment means comprises mating "loop and hook" fasteners.

8. A purse split insert which is insertable into first and second purse compartments within a split compartment purse and into a sole compartment within a single compartment purse, comprising a first purse insert, a first exterior wall on said first purse insert, said first exterior wall being flexible and having a lower edge, an upper edge and opposing lateral edges, a first interior wall on said first purse insert, said first interior wall being flexible and having a lower edge, an upper edge and opposing lateral edges, a first pair of expandable opposing end walls on said first purse insert, said first exterior and interior walls having inside surfaces thereon and being joined at said lower edge, said first pair of expandable opposing end walls being attached to and extending between said first exterior and interior walls at said opposing lateral edges and extending along said opposing lateral edges from a position spaced below said first exterior and interior wall upper edges to said first exterior and interior wall lower edges, whereby said first purse insert has an upper opening therein, means positioned in registered opposing relationship on said inside surfaces of said first exterior and interior walls adjacent said first exterior and interior wall upper edges for releasably fastening said first exterior and interior wall upper edges together to provide open unfastened and closed fastened modes for first purse insert upper opening, a second purse insert a second exterior wall on said second purse insert, said second exterior wall being flexible and having a lower edge, an upper edge and opposing lateral edges, a second interior wall on said second purse insert, said second interior wall being flexible and having a lower edge, an upper edge and opposing lateral edges, a second pair of expandable opposing end walls on said second purse insert, said second exterior and interior walls having inside surfaces thereon and being joined at said lower edge, said second pair of expandable opposing end walls being attached to and extending between said second exterior and interior walls at said opposing lateral edges and extending along said opposing lateral edges from a position spaced below said second exterior and interior wall upper edges to said second exterior and interior wall lower edges, whereby said second purse insert has an upper opening therein, means positioned in registered opposing relationship on said inside surfaces of said second exterior and interior walls adjacent said second exterior and interior wall upper edges for releasably fastening said edges together to provide open unfastened and closed fastened modes for said second purse insert upper opening, and releasable means for attaching said first interior wall to said second interior wall, whereby said first and second purse inserts are selectively joined together and separated for insertion within a single compartment purse and within a split compartment purse respectively.

9. The purse split insert of claim 8 comprising means for forming pockets attached to and opening upwardly on said first and second exterior and interior wall inside surfaces, said last named means being accessible through said first and second purse insert upper openings.

10. The purse split insert of claim 8 comprising outside surfaces on said first and second exterior walls, and means for forming pockets attached to and opening upwardly on said outside surfaces and being accessible at said outside surfaces.

11. The purse split insert of claim 8 wherein said releasable means for attaching comprises cooperating pressure engagement means attached to said first and second interior walls for engagement when pressed together and disengagement when pulled apart.

12. A purse split insert for placement as separate inserts within separate purse compartments in a split compartment purse and as a joined unitary insert pair within a single compartment in a single compartment purse, wherein a first insert comprises a first folded continuous member having spaced facing inside surfaces and opposing lateral edges and having opposing ends positioned in spaced side by side relationship, each of said opposing lateral edges thereby having adjacent side by side portions, expandable first means for joining said adjacent side by side portions of each of said opposing lateral edges, said expandable first means for joining having upper edges, whereby a first upper opening for the first insert is formed between said first folded continuous member opposing spaced ends and said upper edges on said expandable first means for joining, said expandable first means for joining extending along said opposing lateral edges to positions spaced below said first folded continuous member opposing ends, first means for releasably closing and opening said first upper opening mounted on said spaced facing inside surfaces adjacent said opposing ends on said first folded continuous member, and wherein a second folded continuous member comprises a second folded continuous member having spaced facing inside surfaces and opposing lateral edges and having opposing ends positioned in spaced side by side relationship, each of said opposing lateral edges thereby having adjacent side by side portions, expandable second means extending between said spaced facing inside surfaces for joining said adjacent side by side portions of each of said opposing lateral edges, said expandable second means for joining having upper edges whereby a second upper opening for the second insert is formed between said second folded continuous member opposing spaced ends and said upper edges on said expandable second means for joining, said expandable means for joining extending along said opposing lateral edges to positions spaced below said second folded continuous member opposing ends, second means for releasably opening and closing said second upper opening mounted on said spaced facing inside surfaces adjacent said opposing ends on said second folded continuous member, and releasable means for attaching said first and second folded continuous members together so that said first and second upper openings are in adjacent side by side relationship.

13. The purse split insert of claim 12, comprising means for forming pockets on said first and second folded continuous members, said last named means being attached to and having pocket openings extending substantially upwardly on said spaced facing inside surfaces and further being accessible through said first and second upper openings.

14. The purse split insert of claim 13, comprising means for alternatively closing and opening said pocket openings.

15. The purse split insert of claim 12 wherein said first and second folded continuous members have first and second outside surfaces respectively when joined together by said releasable means for attaching, and means for forming pockets attached to said first and second outside surfaces.

16. The purse split insert of claim 12 wherein said first and second folded continuous members have first and second inside surfaces respectively and wherein said releasable means for attaching comprises cooperating means for engagement attached to said first and second inside surfaces in matching patterns thereon for selective engagement and release.

* * * * *